US007108258B2

(12) United States Patent
Groegor et al.

(10) Patent No.: US 7,108,258 B2
(45) Date of Patent: Sep. 19, 2006

(54) APPARATUS FOR FEEDING FLAT ITEMS

(75) Inventors: Erich Groegor, Constance (DE); Gerhard Obier, Berlin (DE); Holger Schererz, Rehfelde (DE)

(73) Assignee: Siemens AG, München (DE)

( * ) Notice: Subject to any disclaimer, the term of this patent is extended or adjusted under 35 U.S.C. 154(b) by 0 days.

(21) Appl. No.: 10/763,215

(22) Filed: Jan. 26, 2004

(65) Prior Publication Data

US 2004/0201161 A1 Oct. 14, 2004

Related U.S. Application Data

(63) Continuation of application No. PCT/DE02/02882, filed on Aug. 6, 2002.

(30) Foreign Application Priority Data

Aug. 9, 2001 (DE) ..... 101 39 231

(51) Int. Cl.
*B65H 3/08* (2006.01)

(52) U.S. Cl. ..... 271/108; 271/104; 271/258.01

(58) Field of Classification Search ..... 271/94, 271/104, 108, 150, 152, 153, 258.01, 260
See application file for complete search history.

(56) References Cited

U.S. PATENT DOCUMENTS 5,154,407 A * 10/1992 Shidara ..... 271/12
5,391,051 A * 2/1995 Sabatier et al. ..... 414/797.2
5,513,817 A * 5/1996 Nelson et al. ..... 242/419.3
6,186,491 B1 * 2/2001 Tomiyama et al. ..... 271/12
6,443,444 B1 * 9/2002 Cera et al. ..... 271/108
6,575,450 B1 * 6/2003 Blackwell et al. ..... 271/11
6,702,275 B1 * 3/2004 Niiyama et al. ..... 271/98

FOREIGN PATENT DOCUMENTS

| | | |
|---|---|---|
| DE | 19612567 | 4/1999 |
| EP | 0990609 A | 4/2000 |
| WO | WO-0124949 A | 4/2001 |

OTHER PUBLICATIONS

Derwent Abstract DE 19612567 C2, Apr. 29, 1999, Siemens AG.
DATABASE WPI, Derwent Publications Ltd., London, GB; An 2001-568307.
Patant Abstracts of Japan, Publication No. 11020959, vol. 1999, No. 04, Applicant: Canon Inc.

* cited by examiner

*Primary Examiner*—Kathy Matecki
*Assistant Examiner*—Thomas A. Morrison
(74) *Attorney, Agent, or Firm*—Siemens AG

(57) ABSTRACT

The invention relates to a device for the delivery of flat objects to a friction/suction picking device with a suction head, the objects standing in a stack on a thin edge thereof on a support surface arranged on a stop surface and transported in the direction of the picking point using conveyor means. A sensor for measuring the vacuum in the suction head, is arranged on or in the suction head, which is connected to the drive controller on the conveyor means. Depending on the measured vacuum the conveyor means can be controlled such that the front object has an inclination as low as possible with the lowest possible stack pressure on the at least one friction picking device.

7 Claims, 2 Drawing Sheets

APPARATUS FOR FEEDING FLAT ITEMS

CROSS REFERENCE TO RELATED APPLICATIONS

The present application is a continuation of international application PCT/DE02/02882, filed Aug. 6, 2002 and claims priority to German application 10139231.1, filed Aug. 9, 2001, the both of which are herein incorporated by reference.

BACKGROUND OF THE INVENTION

The invention relates to an apparatus for feeding flat items, e.g. (large) letters or cards, to a suction-type separating arrangement according to the preamble of claim 1.

In separating apparatuses which are intended for flat items and, from a stack of flat items which is positioned on a more or less horizontally arranged conveying belt or chain as the transporting means, withdraw individual items from the end of the stack, it is customary for the stack, which becomes shorter and shorter as a result of the items being withdrawn, to be fed to the separating apparatus (VE). These VEs use, inter alia, friction technology. The contact pressure of the first item was achieved here by the stack behind it pressing the first item onto the withdrawal element/s (AE). A frictional force acting in the withdrawal direction thus built up as a result of the normal force acting between AE and item. The disadvantage, however, was that this normal force also acted between the first and second items. The apparatus thus only functions reliably as long as the coefficient of friction between AE and item is greater than between the first and second items. Otherwise, the first and second items may be withdrawn together (double withdrawal). VEs with relatively high throughput requirements, meanwhile, use friction/suction technology in order to achieve optimum separating rates in respect of quality and quantity. The system of these friction/suction-type separators (RSV) makes it possible to resolve this contradiction since the necessary normal force is produced by the additional attachment by suction, and the advancement means then merely has the task of conveying items up to the VE. The normal force between the item which is to be withdrawn and the following item can approach zero as far as the withdrawal operation is concerned.

For optimum throughput, it is necessary, once one item has been withdrawn, for the next item to be available at the VE as quickly as possible without the abovementioned effects occurring. Up until now, for this purpose (see FIG. 2), use has been made of apparatuses which sensed the force of the stack 4 positioned against them and thus, in the case of the force decreasing or being absent, set the advancement mechanism, e.g. a circulating conveying belt 5, in operation (DE 196 12 567 C2). The items to be withdrawn were thus pressed against force-sensing elements, e.g. spring-loaded levers 3. Two of these levers are provided for each withdrawal arrangement, in such a manner that they can be moved independently of one another. Furthermore, you are evaluated via at least one sensor 9 (displacement or pressure).

In order to avoid the inclined positions detrimental to RSVs (lack of planar position against suction element=loss of negative pressure=less frictional force), these levers are evaluated with an AND connection, i.e. the advancement means is only switched off when both levers give the logical signal "active". The disadvantage here is that the force produced by these levers acts in the same direction as the normal force which is necessary for withdrawal purposes. An obvious advantage of the RSV is relinquished again here. This is disadvantageous particularly in the case of items such as letters and flat items, since the forces which are necessary for optimum stack sensing are approximately in the same order of magnitude as the normal forces at withdrawal. The levers 3 force the items of the stack 4 away from the withdrawal means 1 (suction belt). The suction force thus always has to overcome the lever force. The levers 3 act statically as a brake between the withdrawal system and the item which is to be withdrawn and reduce the frictional force during the withdrawal process. Furthermore, at the moment at which the item is attached to the frictional elements by suction, the lever 3, rather than "measuring" the stack 4, only "measures" the item butting against it. It is only when the item has been drawn out of the lever mechanism that the lever 3 can sense the stack 4. For a high withdrawal capacity, the advancement system has to be very quick and/or integrated over a number of cycles.

SUMMARY OF THE INVENTION

The object of the invention is thus to provide an apparatus which is intended for feeding flat items to a friction/suction-type separating arrangement and in the case of which the withdrawal operation is not adversely affected by the measuring means which detect the items at the withdrawal location and are intended for controlling the conveying means which transports the items to the withdrawal location.

The object is achieved according to the invention by the features of claim 1.

By virtue of using a sensor which is connected to the drive control device of the conveying means and measures the negative pressure in the suction head, it being possible for the conveying means to be activated in dependence on the negative pressure measured and thus on the spacing and/or on the inclined position of the foremost item, the spacing and/or the amount by which said item is inclined decreasing as the negative pressure increases, i.e. as the absolute pressure decreases, such that the foremost item on the friction-type withdrawal means is inclined as little as possible, with the stack pressure being as low as possible, measuring influences which have an adverse effect on the withdrawal operation, as is the case with the use of sensing levers, are avoided. Moreover, the construction of the measuring apparatus is simplified.

Advantageous configurations of the invention are explained in the subclaims.

It is thus advantageous, for the purpose of reducing the control outlay, for the drive control device to be designed such that, if the negative pressure drops below a defined value, i.e. the absolute pressure measured is above the defined pressure value, the conveying means is displaced at constant speed in the direction of the withdrawal location, and that, if another defined negative pressure is exceeded, i.e. the absolute pressure measured is below the defined pressure value, the conveying means is stopped.

Since the spacing between the items and the friction-type withdrawal means from which these items are drawn onto the friction-type withdrawal means by the negative pressure depends greatly on the mass of the items, it is advantageous for the measured values of the sensor to be integrated in the drive control device and for the conveying means to be displaced in accordance with the current integrated values.

In this context, it is particularly advantageous to use the measured values of the sensor to form mean values in accordance with which the conveying means is displaced.

It is also advantageous to configure the drive control device such that the speed of the conveying means is in inverse proportion to the negative pressure measured.

In a further advantageous configuration, for high items of mail, a plurality of suction heads each with a sensor connected to the drive control device for determining the inclined position, and the movement of the conveying means derived therefrom, are arranged one above the other.

If the intention is to separate items which cover a wide range of heights, then it is advantageous for the height of the respective item to be measured and for the drive control device to be configured such that, in the case of items of mail which, on account of their height, do not cover over all of the suction heads, the negative pressures of the suction heads which are only partially covered over, if at all, are not evaluated.

It is further advantageous for a circulating withdrawal belt with suction openings to be provided as the friction-type withdrawal means, the negative pressure of the downstream suction head acting, via the suction openings, on the respectively foremost item.

BRIEF DESCRIPTION OF THE SEVERAL VIEWS OF THE DRAWINGS

The invention is explained in more detail in the following text with reference to the drawing.

DETAILED DESCRIPTION OF THE INVENTION

Figure 1:
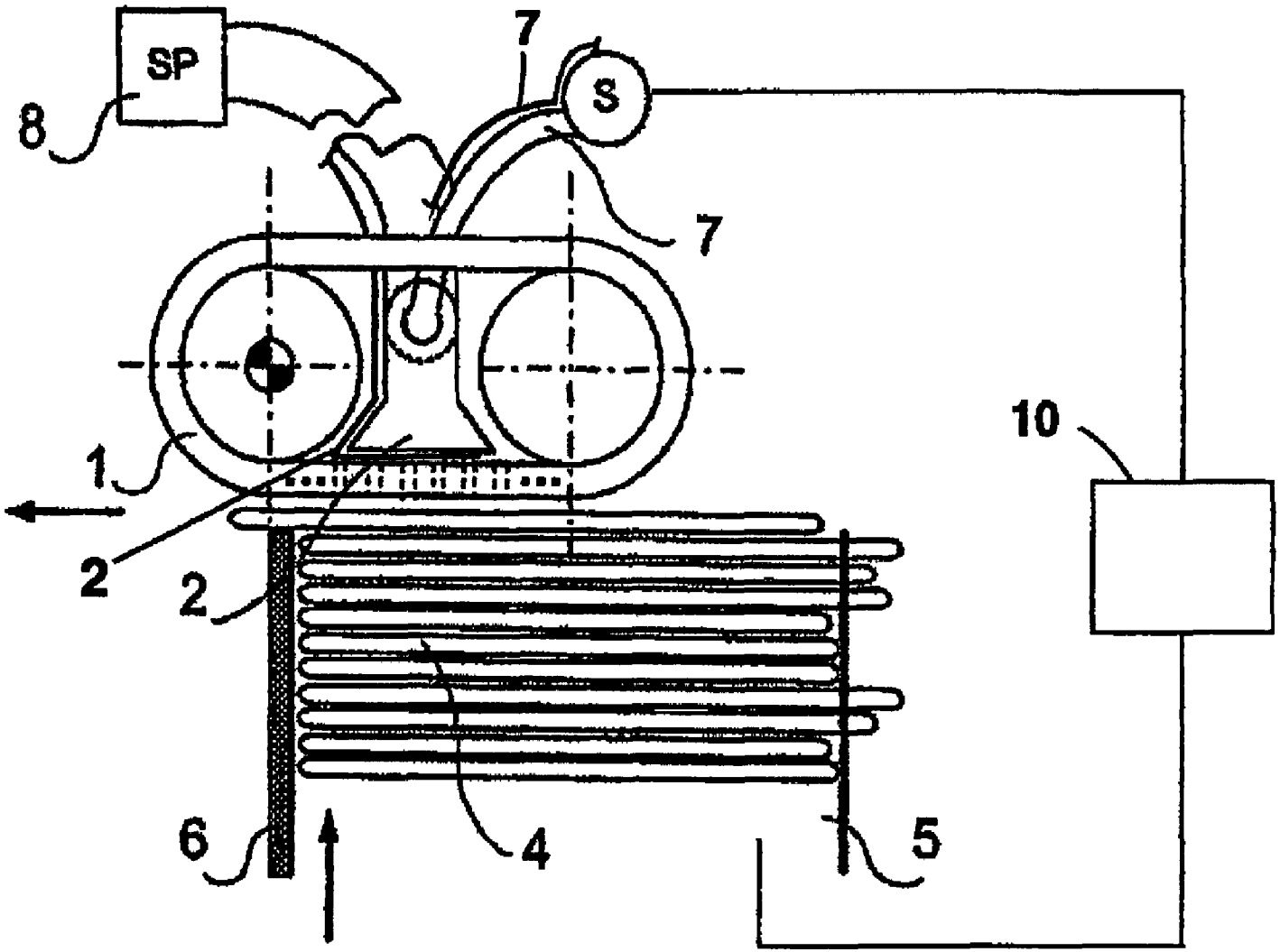
FIG. 1 shows a schematic plan view of a friction/suction-type separating arrangement with a sensor.
Figure 2:
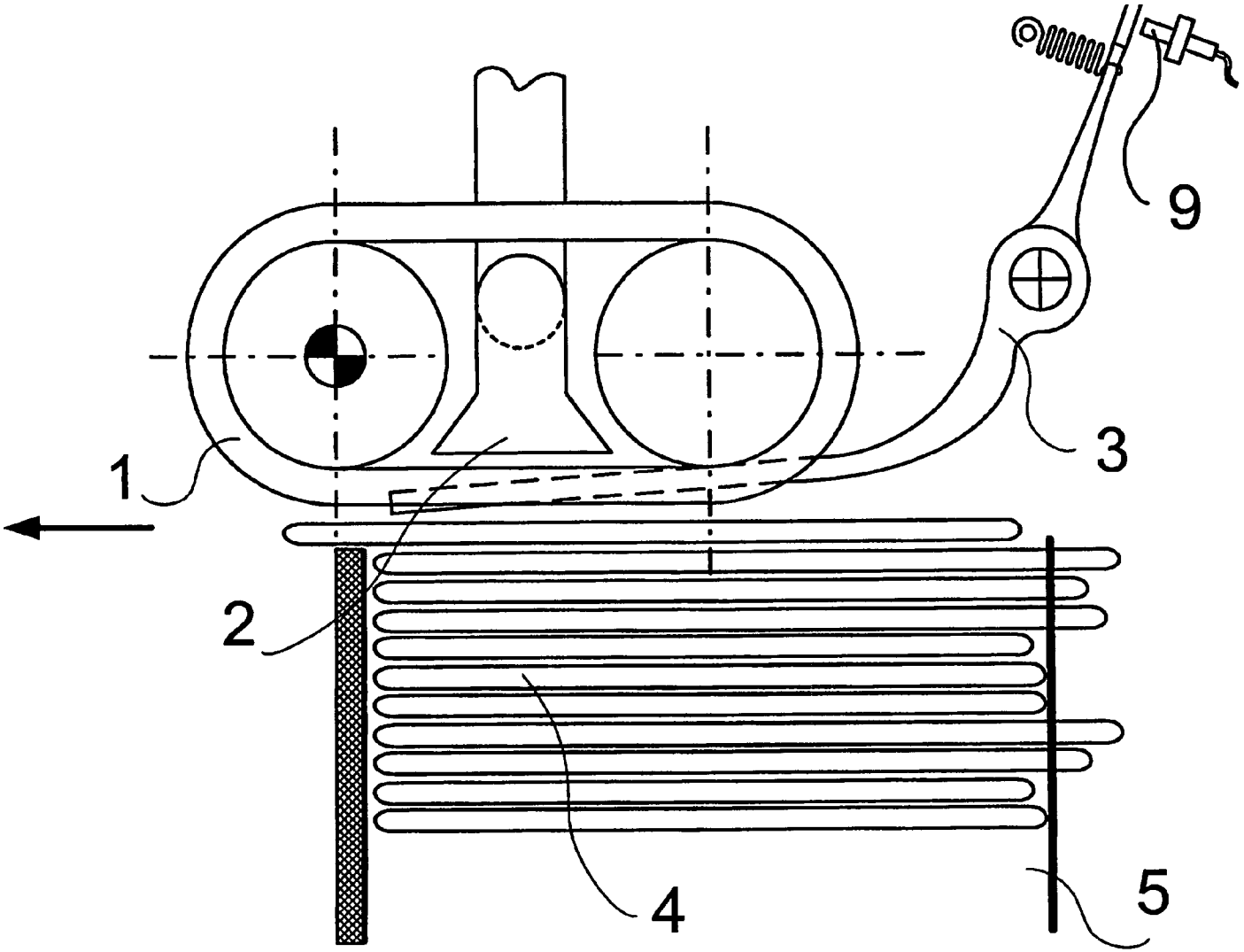
FIG. 2 shows a schematic plan view of a friction/suction-type separating arrangement with sensing levers according to the prior art.

FIG. 1 illustrates a friction/suction-type separating arrangement which has a circulating withdrawal belt 1 with suction openings as the friction-type withdrawal means. Located directly downstream of the item-withdrawing region of the withdrawal belt 1 with a high coefficient of friction is a suction head 2, which is connected to a negative-pressure source 8. A sensor 7 is located on the suction head 2 and measures the negative pressure in the latter.

The stack 4 of flat items stands on a conveying belt 5, as conveying means, and is supported, on the rear side, on an abutment surface (not illustrated) which can be displaced with the conveying belt 5 in the direction of the separating apparatus. The stack 4 is aligned on a stop surface 6 which is located laterally on the conveying belt 5. The sensor 7 on the suction head 2 constantly measures the negative pressure prevailing in the suction head 2. The negative pressure is realized by an externally arranged negative-pressure source 8 (suction pump). The items lean loosely against the withdrawal unit on the withdrawal side and/or are located such that they lean back in the direction of the abutment surface. The withdrawal operation is started, and the negative-pressure source 8 produces a negative pressure. If an item butts in a planar manner against the withdrawal unit, a specific negative pressure for the range of goods will be established. If the item of mail, rather than abutting in a planar manner, is located in one of the two abovementioned manners in relation to the withdrawal unit, a low negative pressure will form, i.e. the absolute pressure increases since, in dependence on the size of the gap, secondary air is drawn in. The negative pressure prevailing is thus a direct expression of the position of the items in relation to the withdrawal unit. The sensor 7 registers the negative-pressure conditions and signals to the control device 10 when the negative pressure in the suction head 2 is too low, i.e. when the absolute pressure measured exceeds the nominal value. The drive control device then starts the conveying belt 5. The conveying belt 5 moves the stack 4 in the direction of the withdrawal belt 1. The next item is transported into the suction-attachment region, where it is gripped by the suction air and attached to the withdrawal belt 1 by suction. Since the item is then located parallel to the suction-head opening, the negative pressure increases, i.e. the absolute pressure measured decreases, the measured value of the sensor 7 reaches a settable desired value, and the conveying belt 5 is thus switched off by the drive control device and the item is withdrawn.

Since the spacing between the item and the withdrawal belt 1 from which this item is drawn onto the belt by the suction force depends greatly on the mass of this item, thin lightweight items are attached by suction sooner than large heavy ones. This means that, apart from in the case of very thick and heavy items, the evaluation of the sensor signal has to be integrated since it is not possible to move the conveying belt 5 at a time analogous to that of the item which has just been withdrawn.

A mean value is formed from the sensor signal. It is likewise possible for an analog system to be selected and for the conveying belt 5 to be operated, as far as possible, continuously at a regulated speed. In the case of known withdrawal arrangements, for example approximately 10 . . . 15 items of mail with an average thickness of approximately 2 mm are withdrawn per second. That is to say, with an assumed equal distribution of the items of mail, the stack has to be advanced at an average speed of at least 20 mm/sec. If it is desired to withdraw thicker items, the sum of the thicknesses of the items of mail withdrawn per unit of time has to be assumed as the basis of the drive and control configuration. The decision is to be made as to whether a digital or an analog drive control device is preferred in dependence on the suction-attachment behavior of the items. For example, in the case of withdrawal arrangements for thin sheets, all that is required in some circumstances, if 10–15 sheets are to be withdrawn per second, is for a stack to be advanced at approximately 1 . . . 2.5 mm/sec. It will usually be sufficient here to use a digital drive control device and to set the sensor 7 such that, in the case of an item of mail being spaced apart from the withdrawal belt 1 by approximately 2–4 mm, the threshold value is exceeded and the conveying belt 5 is displaced by a step of between 2–3 mm approximately every 1–2 seconds.

In other application cases, e.g. in the case of items of different thicknesses being separated, it may be advantageous to make use of an analog process and to assign different speeds to different negative-pressure values, and to configure the regulating behavior such that operation can take place with the highest possible level of continuity and with as few start/stops as possible.

It may likewise be advantageous, for certain applications in which items of vastly different heights are processed, for a plurality of suction chambers each with a sensor to be arranged one above the other in order for the position of the item in relation to the withdrawal unit to be detected precisely. This makes it possible to react adequately to the respective type of inclined positioning of high items. Furthermore, it is also possible for flat items which only cover one suction chamber to be processed in a mix with high items which cover a plurality of suction chambers, in that the heights of the items are measured and, in the case of items which, on account of their height, do not cover over all the suction heads, the negative pressures of the suction heads which are only partially covered over, if at all, are not evaluated.

The apparatus described has the advantage over known solutions that the stack-advancement function no longer has any mechanical elements, levers/springs.

The size factor which is necessary for measurement no longer adversely affects the process which is to be controlled. Instead of the two displacement/force sensors described in the prior art, just one sensor is now necessary.

The solution is thus less expensive, more straightforward and easier to maintain than that of the prior art.

We claim:

1. An apparatus for feeding flat items to a friction/suction separating arrangement, comprising:

a stop surface configured to align the items;

a conveying means configured to transport the items to a withdrawal location;

at least one friction withdrawal means driven in a controlled manner, and having a region configured to act upon the items;

at least one suction head connected to a negative-pressure source and positioned in proximity of the region so that the region is between the items and the suction head;

a sensor coupled to the suction head to measure a negative pressure in the suction head;

a drive control device coupled to the conveying means and configured to control the conveying means, wherein the drive control device activates the conveying means in dependence of the negative pressure; and wherein the drive control device comprises means for setting a speed of the conveying means as an inverse proportion of negative pressure measured.

2. The apparatus according to claim 1, wherein the drive control device comprises means for displacing the conveying means at a substantially constant speed if the negative pressure drops below a defined value, and for stopping the conveying means if another defined negative pressure is exceeded.

3. The apparatus according to claim 1, wherein measured values of the sensor are integrated over time and the conveying means is displaced in accordance with current integrated values.

4. The apparatus according to claim 3, wherein mean values are formed from the measured values of the sensor and the conveying means is displaced in accordance with current mean values.

5. The apparatus according to claim 1, further comprising a plurality of successively arranged suction heads for high items, each of the suction heads comprising a sensor and being coupled to the drive control device for determining an inclined position and driving the conveying means in dependence of the inclined position.

6. The apparatus according to claim 5, wherein the apparatus is configured to measure the heights of the items and to disregard negative pressures of suction heads that are only partially covered.

7. The apparatus according to claim 1, further comprising a circulating withdrawal belt with suction openings arranged as the at least one friction withdrawal means, with a negative pressure of the at least one suction head acting, via suction openings, on a respectively foremost item.

* * * * *